United States Patent [19]

Collingwood

[11] 3,955,677

[45] May 11, 1976

[54] CORNERBOARD PROTECTOR

[75] Inventor: David S. Collingwood, Bridgeport, Pa.

[73] Assignee: Cornerboard, Inc., Bridgeport, Pa.

[22] Filed: June 3, 1974

[21] Appl. No.: 475,520

[52] U.S. Cl. ..... 206/453; 229/14 C; 229/DIG. 1; 229/DIG. 4; 156/211

[51] Int. Cl.[2] ..... B65D 25/12; B65D 81/06

[58] Field of Search..... 206/453; 229/14 C, DIG. 1, 229/DIG. 4

[56] References Cited

UNITED STATES PATENTS

| | | | |
|---|---|---|---|
| 2,324,031 | 7/1943 | Schieffenhaus | 206/453 X |
| 2,610,936 | 9/1952 | Carlson | 229/49 UX |
| 2,746,667 | 5/1956 | Murphy | 229/14 C |
| 2,896,833 | 7/1959 | Markham | 229/14 C |
| 2,969,906 | 1/1961 | Claff et al. | 229/50 |
| 3,433,354 | 3/1969 | Liebel | 206/521 |
| 3,684,636 | 8/1972 | Rothrock et al. | 229/14 C X |

*Primary Examiner*—Leonard Summer
*Attorney, Agent, or Firm*—Miller, Frailey & Prestia

[57] ABSTRACT

Cornerboard protector comprises laminated cardboard or paperboard with embedded reinforcement strip, which is bent at a right angle along its length, the reinforcement strip being embedded only in the unbent portion of the strip. A V-cut in the bent portion and extending into the unbent portion with its apex terminated just short of the reinforcement strip provides a mitered corner about which the laminate is folded to form a neat and strong corner protector.

6 Claims, 4 Drawing Figures

CORNERBOARD PROTECTOR

This invention pertains to a product used in packaging and shipping heavy articles and particularly to corner protectors used for protecting the corners of such heavy articles in packaging and shipping.

Numerous means have been devised for protecting articles in transit. In the case of heavy articles, such as steel plates, protective packaging materials of sufficient strength are usually expensive and awkward.

Ideally, a reasonably resilient, lightweight and inexpensive material such as cardboard could be folded and used as such a protector but such materials often do not have the necessary strength and are not readily formed into usable shapes with the necessary strength.

Having in mind these problems, it is the general object of the present invention to provide a lightweight, strong, relatively resilient and inexpensive packaging and shipping protector.

It is a more specific object of this invention to provide a formed cardboard product with sufficient strength and proper shape for protecting the corners of heavy articles in shipment.

It is a further object of this invention to provide a method of manufacturing such useful and economical corner protectors.

These and other objects, which will become apparent in the course of the subsequent description of this invention, are met, briefly, by a laminated paperboard or cardboard strip with a flexible reinforcement strip embedded therein, the paperboard or cardboard strip having a mitered cut to facilitate folding of the strip along the length of the cut and thus forming a corner protector with a reinforcement provided at the otherwise weak mitered cut line. The laminated product is bent into a right angle along its length. A "V" shaped cut is then made beginning at the outer edge of one leg (the bent portion) of the right angle and ending, with the apex of the V at or near the reinforcement strip of the other leg (the unbent portion). The cut article is then folded along the cut line of the unbent portion and a mitered corner joint is formed. Two such cuts may be made to produce a U-shaped protector and three such cuts may be made to form a four sided right angle protector.

This invention may be better understood by reference to the following detailed description thereof, taken in conjunction with the subjoined claims and the drawings appended hereto, in which:

Figure 1:
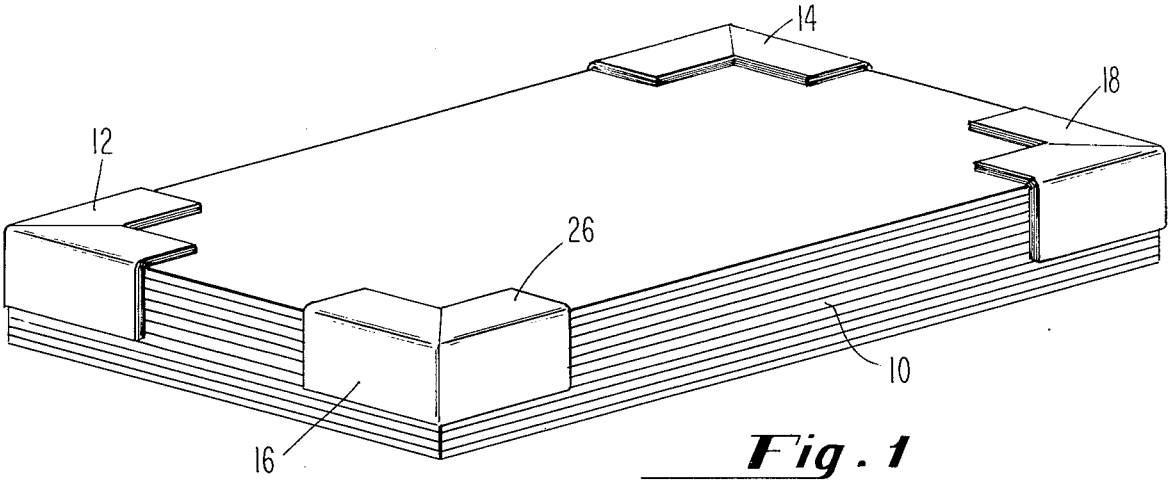
FIG. 1 is a perspective view of a product ready for packaging utilizing the corner protectors of the present invention.

Referring more specifically to FIG. 1, there is shown a material to be protected, such as a stack of steel plates 10, the upper corners of which are each protected by the mitered, reinforced corner protector of the present invention. These corner protectors 12, 14, 16 and 18 are each comprised of reinforced, laminated cardboard, bent, cut and folded to produce a mitered corner form, as described more fully hereinafter.

Figure 2:
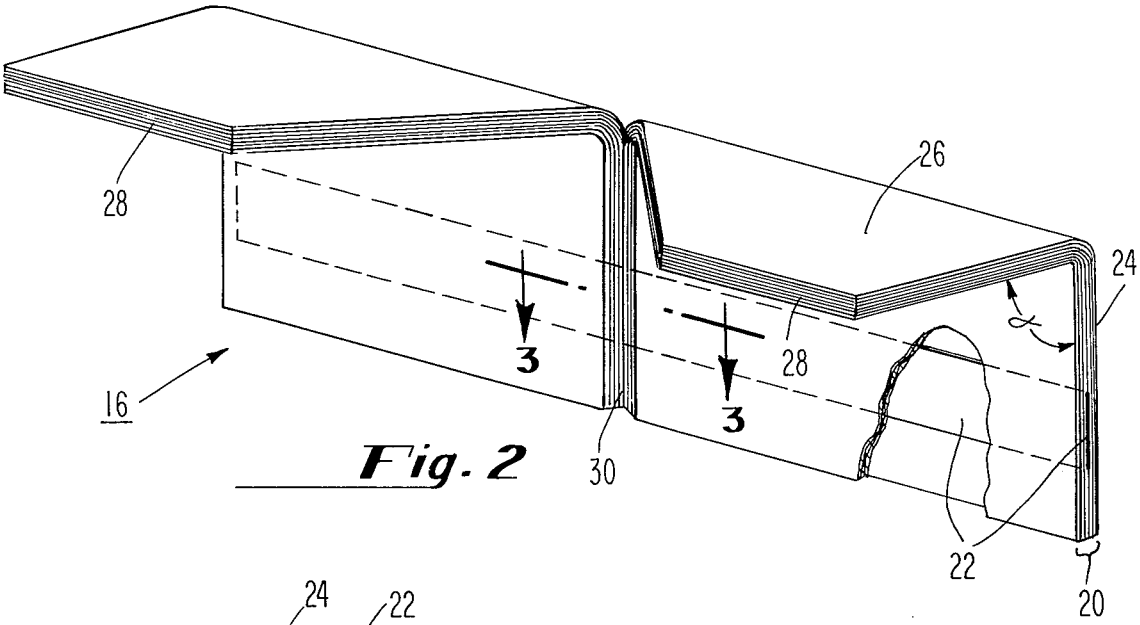
FIG. 2 is a perspective view of a corner protector of the present invention prior to folding into final shape.
Figure 3:
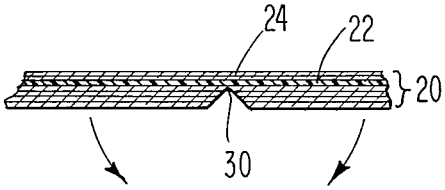
FIG. 3 is a detailed fragmentary sectional view of the protector taken on line 3—3 in FIG. 2.

Referring now to FIG. 2, wherein is shown the preferred form of the present invention, a corner protector 16 as shown in FIG. 1, is seen to consist of several laminae of cardboard 20 with a high strength reinforcement strip 22 embedded therein near outer surface 24 thereof. A portion 26 of the laminated product is bent to form a right angle $\alpha$ with the unbent portion along a line running along the length of the laminated product. Note that bent portion 26 is bent away from outer surface 24. A two-sided V-cut is made beginning at the outer edge 28 of bent portion 26 and terminating in an apex along a line forming an angle with the length of the laminated cardboard 20. The V-shaped apex of the cut 30 is better seen in the detailed sectional view of FIG. 3 wherein is seen the unbent portion of cardboard laminae 20 with the reinforcement strip 22 near outer surface 24 thereof.

Figure 4:
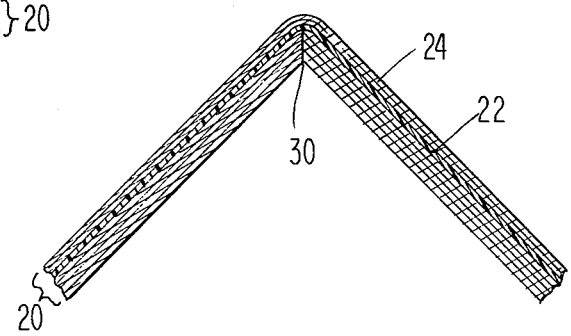
FIG. 4 is a detailed sectional view, after folding, of that part of the protector shown in FIG. 3.

As seen in FIG. 4, the laminae 20 on either side of cut 30 are folded into a right angle about the mitered cut 30 with reinforcement strip 26 preventing any loss in strength at the corner line due to cut 30.

In folding the laminated product, as shown in FIG. 4, the two sides of the cut in bent portion 26 also come together to form the mitered corner protector as shown in FIG. 1.

In the most preferred form of this invention, the embedded reinforcement is a ribbon of continuous rayon filaments lying side by side which extend along the length of the laminated product in the unbent portion thereof. Other materials such as polypropylene, nylon, and polyester are suitable reinforcement materials. The laminated product is of course otherwise a relatively thick, resilient cardboard, some of the laminae of which may consist of less resilient or higher strength cardboard or other material as a substitute therefor.

This invention of course also encompasses the method of making such a useful and inexpensive corner protector as is otherwise disclosed and claimed. This method of making comprises laminating strips of cardboard and embedding therein a reinforcement strip running along an edge of the laminated product near the outer surface thereof. The laminated product is bent along its length to form a right angle between the bent and unbent portions with the reinforcement strip in the unbent portion. A V-shaped cut is then made beginning at the outer edge of the bent portion and continuing into an apex terminating just short of the reinforcement strip in the unbent portion. The product is then folded along the length of the cut in the unbent portion to form a mitered formed protector. In all cases, it is preferred that the angles between the sides of the V-shaped cut be 90° so as to facilitate forming a right angle corner protector. It is of course within the scope of this invention to utilize other angular cuts in order to form corner protectors for other than right angles and to make more than one such mitre cut to form right angle protectors with three, four or even more sides.

Such modifications and other variations of this invention will be apparent to those skilled in the art and the appended claims are intended to be construed to cover all such equivalent variations and modifications which are within the true spirit and scope of this invention.

I claim:

1. Corner protector comprising a strip of resilient, laminated cardboard having an inner and an outer surface and a flexible reinforcement strip along the length thereof embedded between the laminae of said strip near the outer surface of said laminated cardboard said strip being bent all of said laminae toward the inner surface thereof in a line along its length, said cardboard being cut, on the inner surface thereof in the unbent portion thereof through substantially all of said laminae to said reinforcement strip near the outer surface thereof, said cut being made along a line at an angle to the length of said strip, the sides of said cut forming a V-shape with the apex pointing away from said inner surface, said bent portion being cut through all of said laminae along lines continuous with the sides of said V-shaped cut in said unbent portion.

2. Corner protector, as recited in claim 1, wherein said reinfocement strip consists of a series of high strength continuous filaments running in a ribbon, side by side, along the length thereof.

3. Corner protector, as recited in claim 1, wherein said filaments are composed of rayon.

4. Corner protector, as recited in claim 1, wherein said reinforcement strip is narrower than the unbent portion of said laminated cardboard and runs along the length of said unbent portion.

5. Corner protector, as recited in claim 1, wherein said protector is folded along the length of said cut in said unbent portion.

6. Corner protector, as recited in claim 1, wherein the sides of said cut form an angle of 90° therebetween, said protector adapted to be folded along the length of said cut in said unbent portion to form a right angle between the lengths of said protector on either side of said cut in the unbent portion thereof.

* * * * *